US005544502A

United States Patent [19]

Nakamori et al.

[11] Patent Number: 5,544,502

[45] Date of Patent: Aug. 13, 1996

[54] KNITTING YARN FEEDING APPARATUS FOR FLAT KNITTING MACHINE

[75] Inventors: Toshinori Nakamori; Minoru Sonomura, both of Wakayama; Kenji Nakai, Naga-gun, all of Japan

[73] Assignee: Shima Seiki Manufacturing Limited, Wakayama, Japan

[21] Appl. No.: 432,583

[22] Filed: May 1, 1995

[30] Foreign Application Priority Data

May 2, 1994 [JP] Japan ..... 6-093550

[51] Int. Cl.[6] ..... D04B 7/00

[52] U.S. Cl. ..... 66/126 A; 66/64; 66/126 R

[58] Field of Search ..... 66/126 A, 126 R, 66/61, 62, 64, 214, 87, 88, 75.1

[56] References Cited

U.S. PATENT DOCUMENTS

| | | | |
|---|---|---|---|
| 3,237,432 | 3/1966 | Jetté | 66/126 R |
| 3,253,428 | 5/1966 | Pace | 66/126 R |
| 3,733,856 | 5/1973 | Shima | 66/62 |
| 3,818,725 | 6/1974 | Sakuragawa et al. | 66/62 |
| 3,962,890 | 6/1976 | Krause | 66/64 |
| 4,321,807 | 3/1982 | Strong | 66/126 R |
| 4,658,603 | 4/1987 | Stoll et al. | 66/126 R |
| 5,031,423 | 7/1991 | Ikenaga | 66/126 |
| 5,345,789 | 9/1994 | Yabuta | 66/126 A |

FOREIGN PATENT DOCUMENTS

| | | | |
|---|---|---|---|
| 2124927 | 4/1972 | France . | |
| 4026829 | 7/1991 | Germany . | |
| 42225 | of 1976 | Japan . | |
| 199847 | 11/1984 | Japan | 66/126 R |
| 2237034 | 9/1991 | United Kingdom . | |

*Primary Examiner*—John J. Calvert
*Attorney, Agent, or Firm*—Baker & Botts, L.L.P.

[57] ABSTRACT

A knitting yarn feeding apparatus has a base body provided along the longitudinal direction of a front needle bed and a rear needle bed, and plural lace bars movable reciprocally on the base body in the longitudinal direction. Holding blocks are easily attached to and detached from the lace bars. Plural feeder tubes, are detachably fitted to each holding block. From the front end of the feeder tubes, knitting yarn is supplied to the knitting needles of the front needle bed, and the lapping motion is effected by the reciprocal drive of the lace bar in the longitudinal direction. Moreover, the knitting yarn feeding apparatus oscillates and displaces about a swing shaft by an oscillating mechanism provided beneath the front needle bed 11 and rear needle bed, and the front ends of the feeder tubes make a swing motion.

8 Claims, 18 Drawing Sheets

KNITTING YARN FEEDING APPARATUS FOR FLAT KNITTING MACHINE

BACKGROUND OF THE INVENTION

1. Field of the Invention

The present invention relates to a knitting yarn feeding apparatus for a flat knitting machine capable of knitting a texture similar to that of warp knitting by using a flat knitting machine for weft knitting.

2. Description of the Related Art

The prior art of the present invention includes Japanese Examined Patent Publication JP(B2) 51-42225 (U.S. Pat. No. 3,733,856, GB 1353531) filed by the present applicant, or the flat knitting machine (model name SPL-C092FF) manufactured by the applicant.

The flat knitting machine of the above-mentioned type comprises a knitting yarn feeding apparatus which not only feeds knitting yarn to needles with a feeder tube reciprocating on knitting yarn guide rails erected above nozzles between front and rear needle beds, but also enables to form a warp knitting texture through an arbitrary number of feeder tubes for feeding knitting yarn to knitting needles in the needle beds confronting at an upper position of either one of the front and rear needle beds. This knitting yarn feeding apparatus comprises a device which makes it possible that the knitting yarn feeding apparatus oscillates in the vertical direction in order to wind knitting yarn on the confronting knitting needles, and moves in the longitudinal direction of the needle beds.

Knitting by the use of the above-mentioned knitting yarn feeding apparatus capable of forming a warp knitting texture will be briefly described. First, an arbitrary number of knitting needles are advanced above the nozzle, on a needle bed, by passing a cam box of a carriage. In the advanced state of the knitting needles, the knitting yarn feeding apparatus above the confronting needle bed is oscillated from the descending position to the ascending position by passing each feeder tube by the knitting needle side at the advanced position (knitting yarn feed start position). Then the feeder tubes are moved by the portion of a desired number of knitting needles in the same direction as the advancing direction of the succeeding cam box, and are passed again by the knitting needle side to oscillate to the descending position (knitting yarn feed end point). By this action, the knitting yarn is wound about the body of the knitting needle located between the knitting yarn feed start position and the knitting yarn feed end position. In this state, the cam box runs and the knitting needle at the advanced position retreats, and the knitting needle is retracted to form a stitch. Such knitting is repeated, and by feeding knitting yarn in a zigzag form while adjusting the stroke of the feeder tubes in the transverse direction, so that a desired pattern is formed.

That is, as shown in FIG. 18, two groups of feeder tubes 3, 4 are provided in order to feed knitting yarn 2 to plural knitting needles 1 in one needle bed, for example, the front needle bed. From the plural feeder tubes 3 of one of the two groups, yarns 5 of the same color or different colors are supplied as warps. In order to feed knitting yarn 2 as warps in such a manner, it requires the lapping motion that the feeder tubes 3, 4 are oscillated onto the knitting needles 1 at pitches of one or plural knitting needles 1 in relation to horizontal directions L, R, and the swing motion that the feeder tubes 3, 4 cross vertically among the knitting needles

1. In the above-mentioned prior art, plural feeder tubes 3, 4 are mounted on one and the same board, which is externally driven so that the lapping motion and swing motion are generated. The lapping motion is generated by displacing the board in the longitudinal direction of the needle bed along the axis for the swing motion by a link mechanism. In another prior art, lapping motion is effected by using a ball screw or a linear motor.

In the above-mentioned prior art, driving for providing the feeder tubes with the swing motion and driving for providing the feeder tubes with the lapping motion are performed externally by using different mechanisms, and therefore it is necessary to allow the displacement of the board caused by one driving when the other driving is being carried. The mechanisms are fixed to the frame of the flat knitting machine, and therefore a flexible mechanism such as push rod is needed for transmission mechanism of driving force. That is, the swing motion and lapping motion of the feeder tubes are achieved by the mechanisms provided at the frame side of flat knitting machine, and it is required to cope with deflection, if occurring, by using push rod or the like.

In the knitting yarn feeding apparatus of the prior art, however, when it is desired to extend the stroke which is a displacement of the lapping motion, the length of the shaft for swing motion or ball screw or linear motor must be extended, and the mechanism for lapping motion may not settle within the overall width of the flat knitting machine. Besides, since lapping motion or swing motion is effected entirely on the plural feeder tubes, it is hard to adjust the motion range of the distortion stroke.

SUMMARY OF THE INVENTION

It is hence a primary object of the invention to present a knitting yarn feeding apparatus for flat knitting machine capable of easily adjusting the moving stroke of lapping motion when knitting similarly to warp knitting, and knitting in various forms.

The invention provides a knitting yarn feeding apparatus for a flat knitting machine, the apparatus feeding knitting yarn to knitting needles of a fiat knitting machine, comprising:

- a base body having a guide route extending in a longitudinal direction of a needle bed,
- a knitting yarn feeding member detachable from the base body and movable reciprocally on the guide route of the base body, for feeding the knitting yarn to the knitting needles in a state projected from the needle bed by a predetermined height,
- a drive belt applied to move reciprocally in the longitudinal direction of the base body, and having the knitting yarn feeding member coupled at one side thereof,
- a motor provided at a longitudinal end of the base body, for driving the knitting yarn feeding member reciprocally in the longitudinal direction of the base body through the drive belt, and
- an oscillating mechanism for displacing and driving the base body in a flat plane vertical to the longitudinal direction of the base body.

The invention is characterized in that plural guide routes are provided on the base body, plural knitting yarn feeding members are guided on one and the same guide route, plural drive belts and plural motors coupled with each knitting yarn feeding member are provided, driving in plural modes is realized on said one and the same guide route.

Further, the invention is characterized in that the coupling combination among the plural knitting yarn feeding members guided on said one and the same guide route, plural drive belts, and motors is changeable.

Further, the invention is characterized in that the plural knitting yarn feeding members are reciprocally movable on the base body in the longitudinal direction, and the intervals among the knitting yarn feeding members are adjustable.

Further, the invention is characterized in that the knitting yarn feeding member comprises a feeder tube for feeding the knitting yarn to the knitting needles from the front end thereof, a holding block for inserting and holding the feeder tube, and a support member provided with fitting grooves, the holding block has a stopper composed of an elastic spring for fitting into the fitting groove formed in the support member, and by pressing and deforming the stopper, the holding block can be detached from the support member.

According to the invention, the knitting yarn feeding member feeds knitting yarn to the knitting needles in a state being projected from the needle bed by a predetermined height. The knitting yarn feeding member is driven so as to move reciprocally through the drive belt by the motor provided at the end portion of the base body in the longitudinal direction. Accordingly, the knitting yarn feeding member is capable of performing lapping motion on the knitting needles for knitting a texture similar to warp knitting. Since this lapping motion is effected by the drive belt applied so as to move reciprocally in the longitudinal direction of the base body, the moving stroke of the lapping motion can be extended by making effective use of the limited overall width of the base body. The drive belts and motors are mounted on the base body, and the base body is displaced and driven so that the front end of the knitting yarn feeding member may cross the front end position of the knitting needles back and forth, so that the swing motion is realized in a simple mechanism.

Also according to the invention, plural knitting yarn feeding members are guided on one and the same guide route. Each knitting yarn feeding member is driven in plural modes in the longitudinal direction of the base body by plural motors and drive belts, and hence each knitting yarn feeding member performs lapping motion independently. Besides, since each knitting yarn feeding members is mounted on the base body, all knitting yarn feeding members can perform the identical swing motion.

Also according to the invention, the plural knitting yarn feeding members guided on one and the same guide route, plural drive belts, and motors can be changed in the combination of coupling. Accordingly, the plural knitting yarn feeding members guided on the same guide route may be coupled with the same drive belt to act substantially as a single knitting yarn feeding member to knit the same pattern, or may be coupled to different drive belts to knit different patterns, and they may be combined as desired. Furthermore, lapping motions of different strokes can be achieved on the same guide route, and various patterns can be formed by combination of a limited number of knitting yarn feeding members and guide routes.

Also according to the invention, the interval of knitting yarn feeding members can be adjusted. The interval of knitting yarn feeding members determines the stroke range of lapping motion on the same guide route, and hence the length and stroke of the knitting yarn feeding members can be adjusted within this interval range.

Also according to the invention, the holding block in which the feeder tube is inserted can be easily attached and detached from the knitting yarn feeding member. It is hence easy to change combination of feeder tubes, and various warp knitting textures can be easily formed.

Thus, according to the invention, the knitting yarn feeding member can be moved reciprocally in the longitudinal direction of the base body by the drive belt applied so as to move reciprocally in the longitudinal direction of the base body. When the motor moves the knitting yarn feeding member reciprocally through the drive belt, lapping motion is caused on the knitting needle. When the base body is displaced and driven in a plane vertical to the longitudinal direction, swing motion is effected. Since the reciprocal motion in the longitudinal direction is effected by the drive belt, the mechanism for driving in the longitudinal direction is not increased in size, and a knitting similar to warp knitting can be formed by effectively utilizing the overall width of the flat knitting machine.

Also according to the invention, plural knitting yarn feeding members are guided on the same guide route, and each feeding member is individually driven reciprocally. Therefore, many knitting yarn feeding members can be provided on a narrow base body, and are individually driven reciprocally, so that various patterns can be formed.

Also according to the invention, the coupling combination of plural knitting yarn feeding members guided on the same guide route, plural drive belts and motors is changeable, and by varying the combination of the knitting yarn feeding members depending on the patterns to be formed, various knitting patterns can be formed.

Also according to the invention, the interval of plural knitting yarn feeding members is adjustable, and by variously exchanging the knitting yarn feeding members differing in length, the stroke of lapping motion and knitting pattern width are varied, and various patterns can be formed.

Also according to the invention, the holding block can be easily attached and detached from the support member, the feeder tube held in the holding block can be replaced or changed easily.

DETAILED DESCRIPTION OF THE PREFERRED EMBODIMENT

Figure 1:
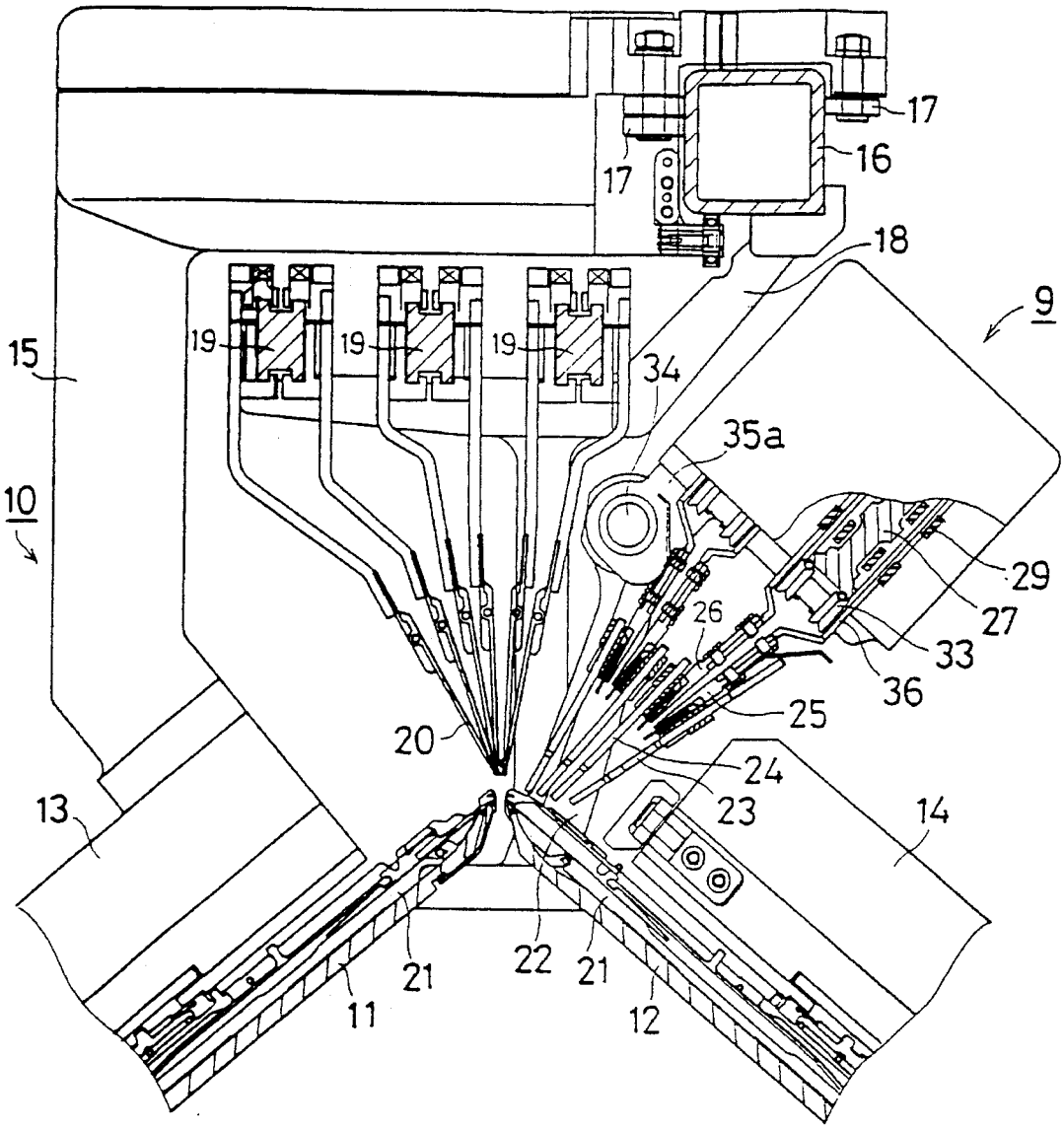
FIG. 1 is a sectional view showing a schematic constitution of an embodiment of the invention.
Figure 2:
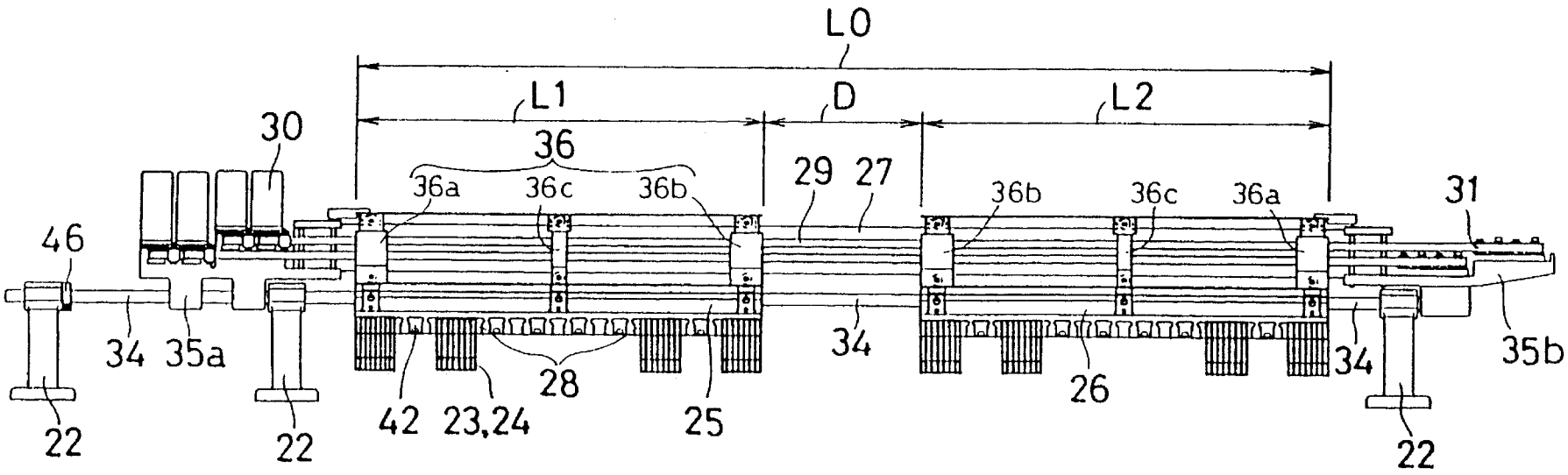
FIG. 2 is a front view of a knitting yarn feeding apparatus 9.
Figure 3:
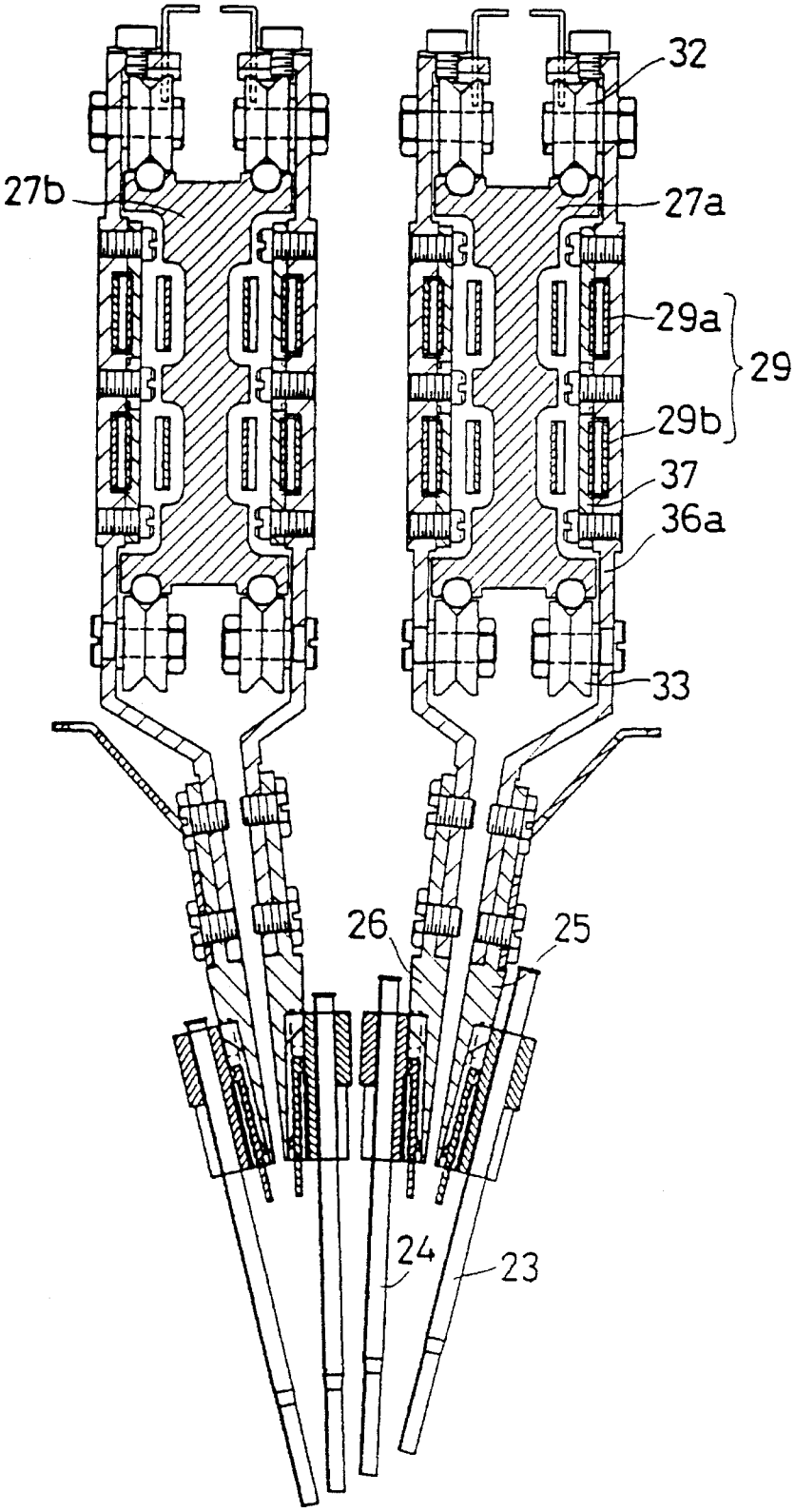
FIG. 3 is a side sectional view of the knitting yarn feeding apparatus 9.
Figure 4:
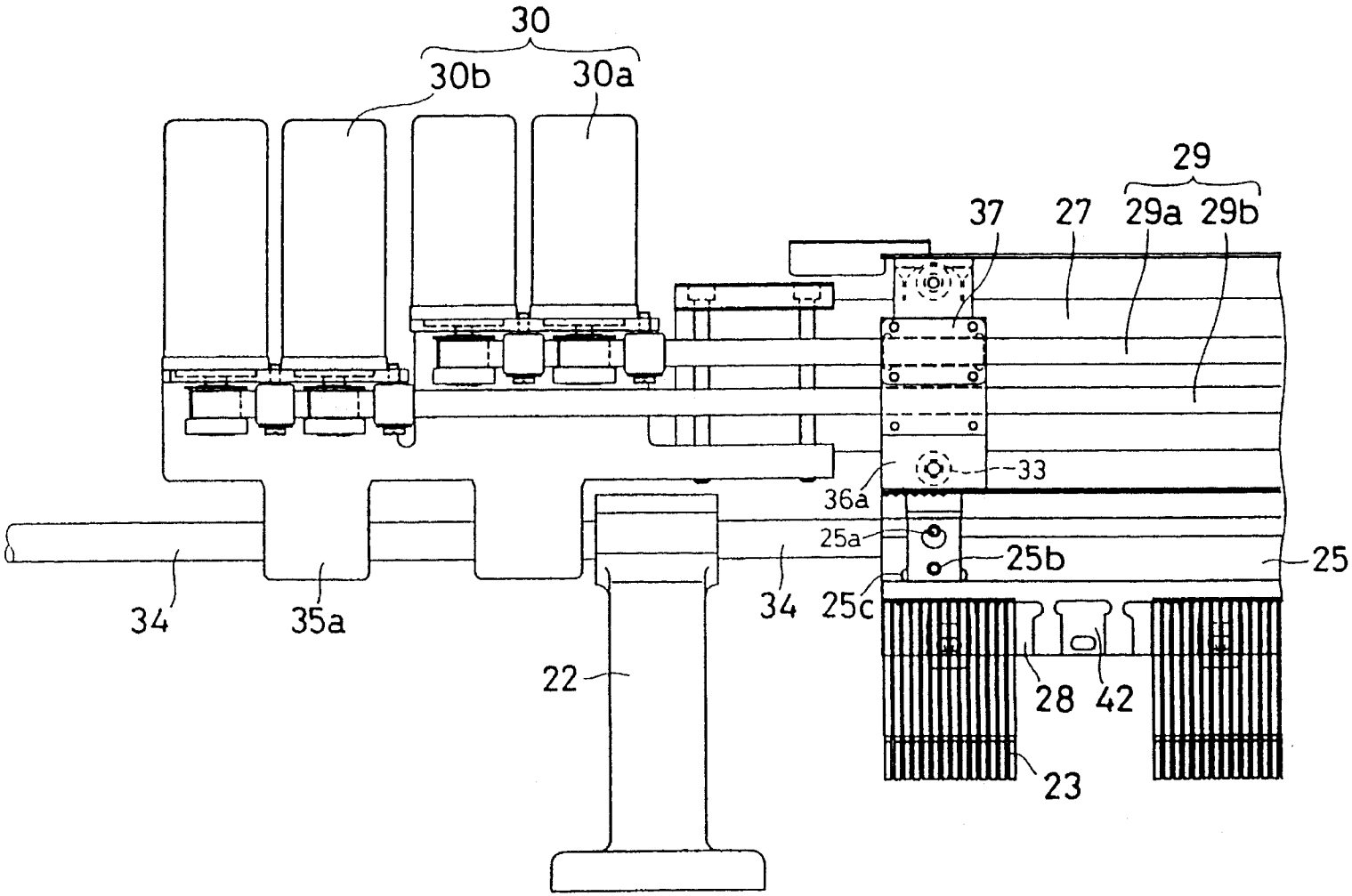
FIG. 4 is a partial front view of the knitting yarn feeding apparatus 9.
Figure 5:
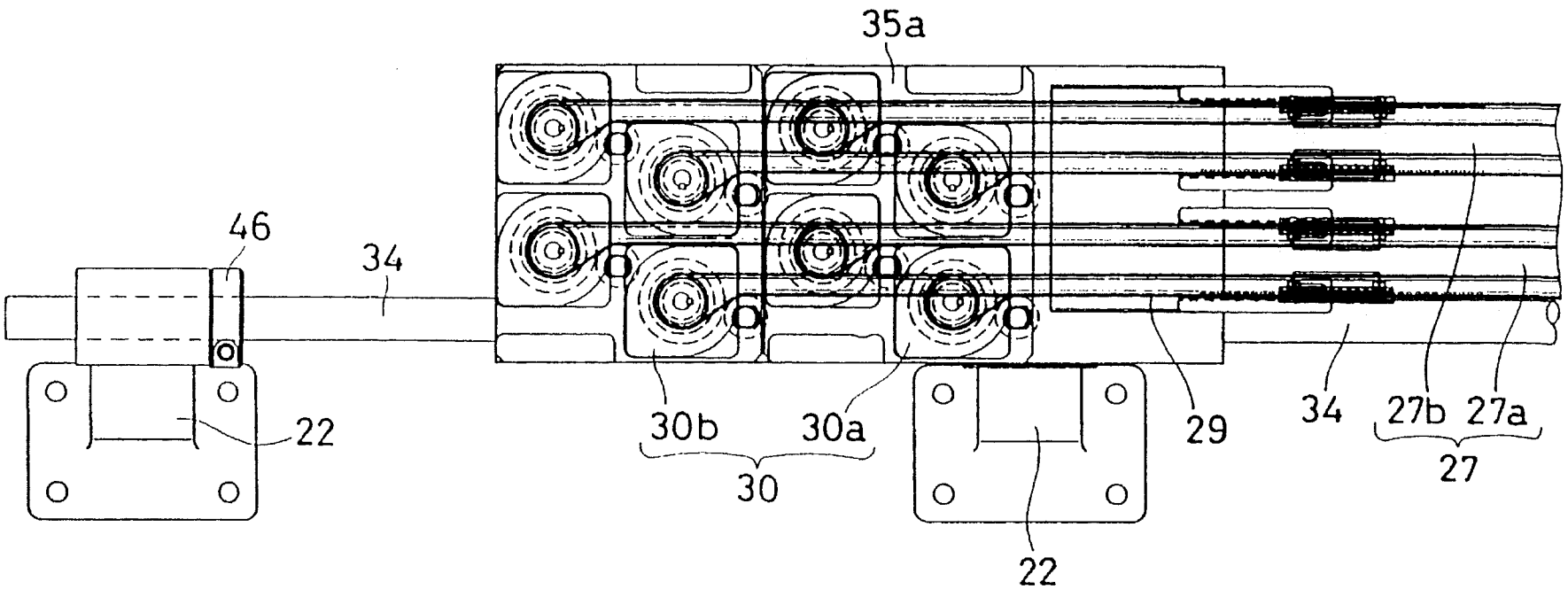
FIG. 5 is a partial plan view of the knitting yarn feeding apparatus 9.
Figure 6:
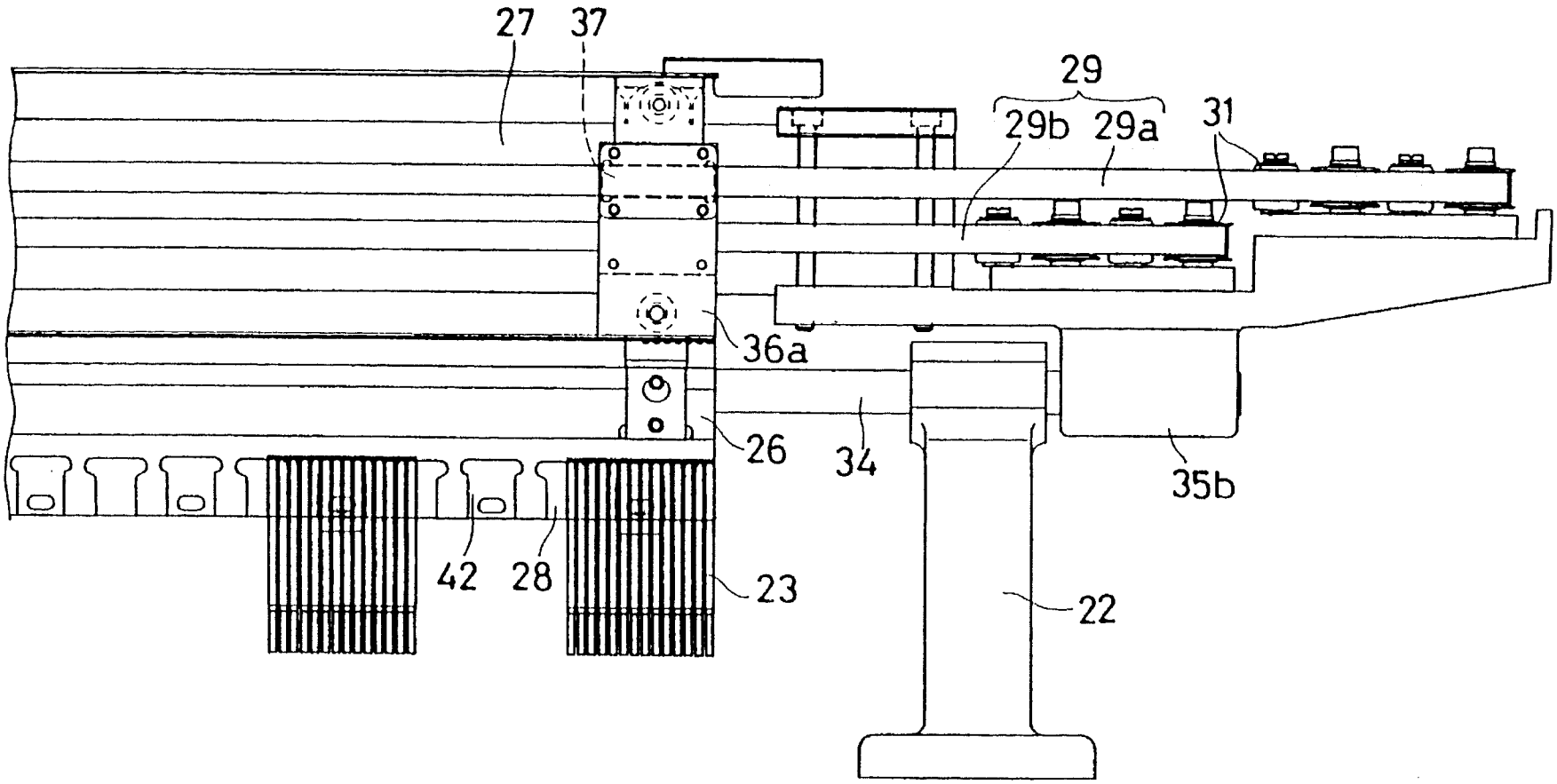
FIG. 6 is a partial front view of the knitting yarn feeding apparatus 9.
Figure 7:
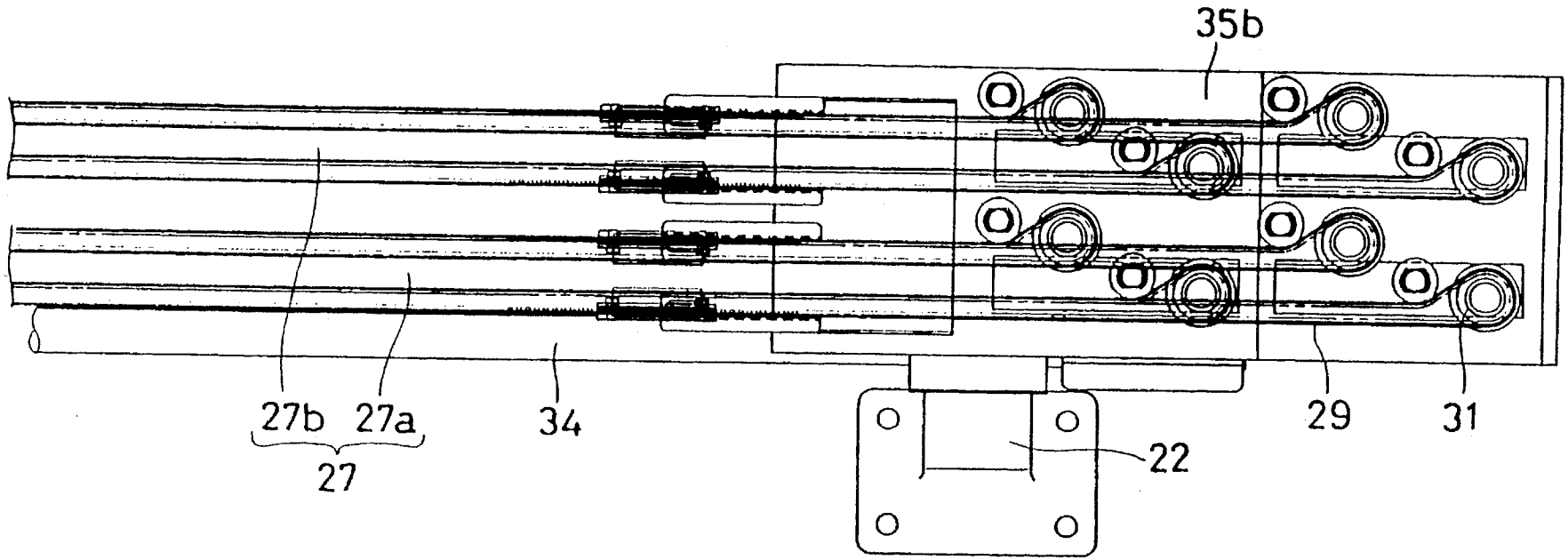
FIG. 7 is a partial plan view of the knitting yarn feeding apparatus 9.
Figure 9:
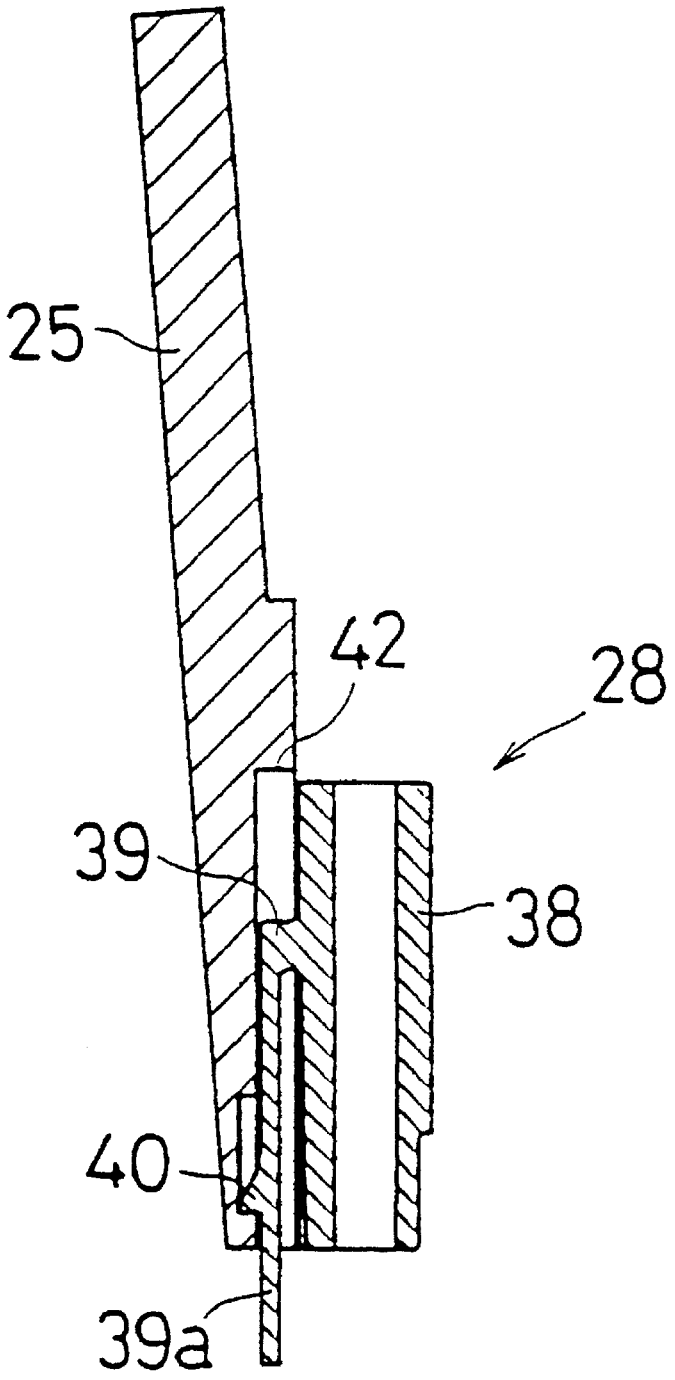
FIG. 9 is a side sectional view showing a mounted state of the holding block 28 on lace bars 25, 26 in the embodiment in FIG. 1.
Figure 10:
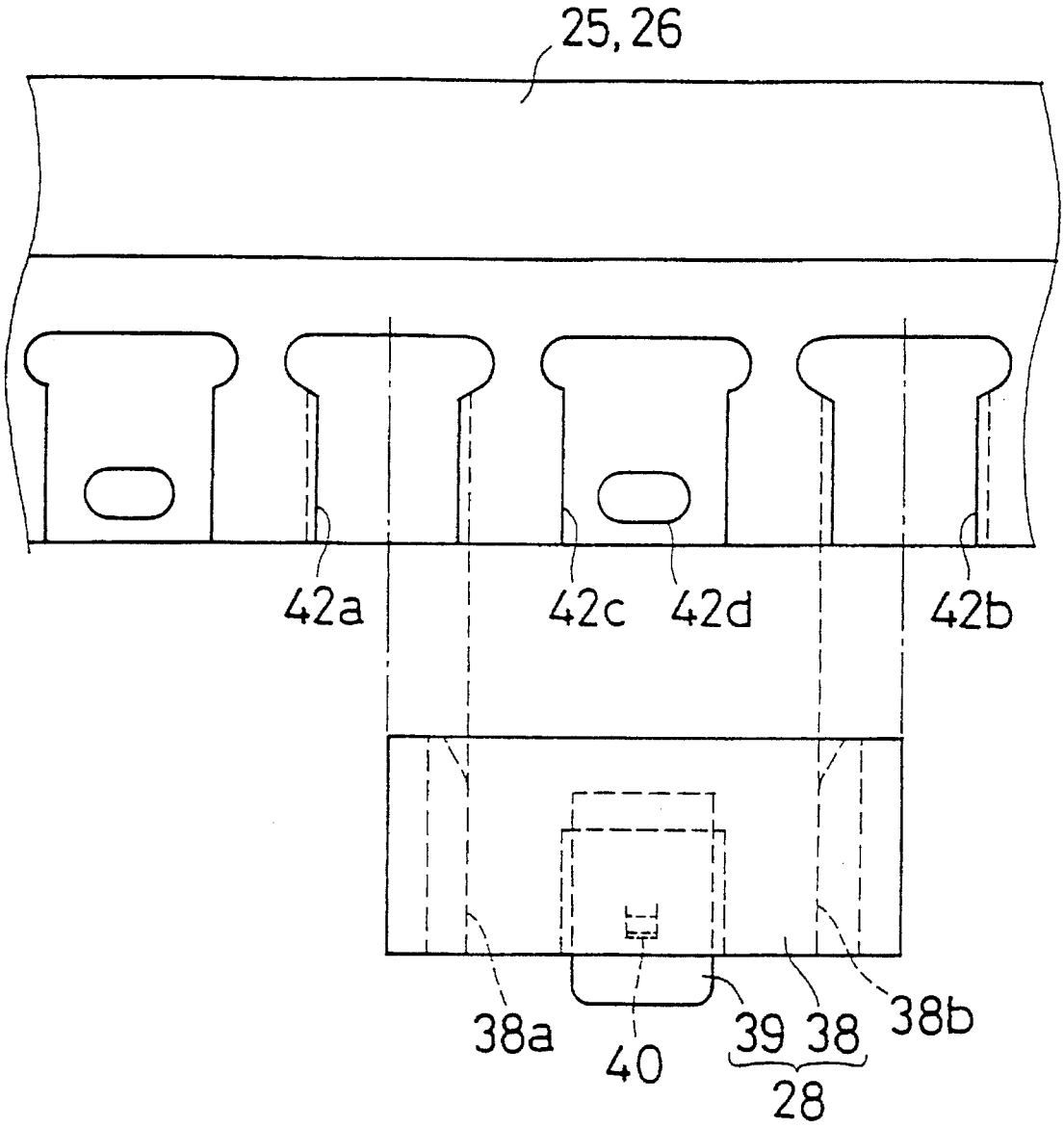
FIG. 10 is a front view showing a mounting state of the holding block 28 on lace bars 25, 26 in the embodiment in FIG. 1.
Figure 11:
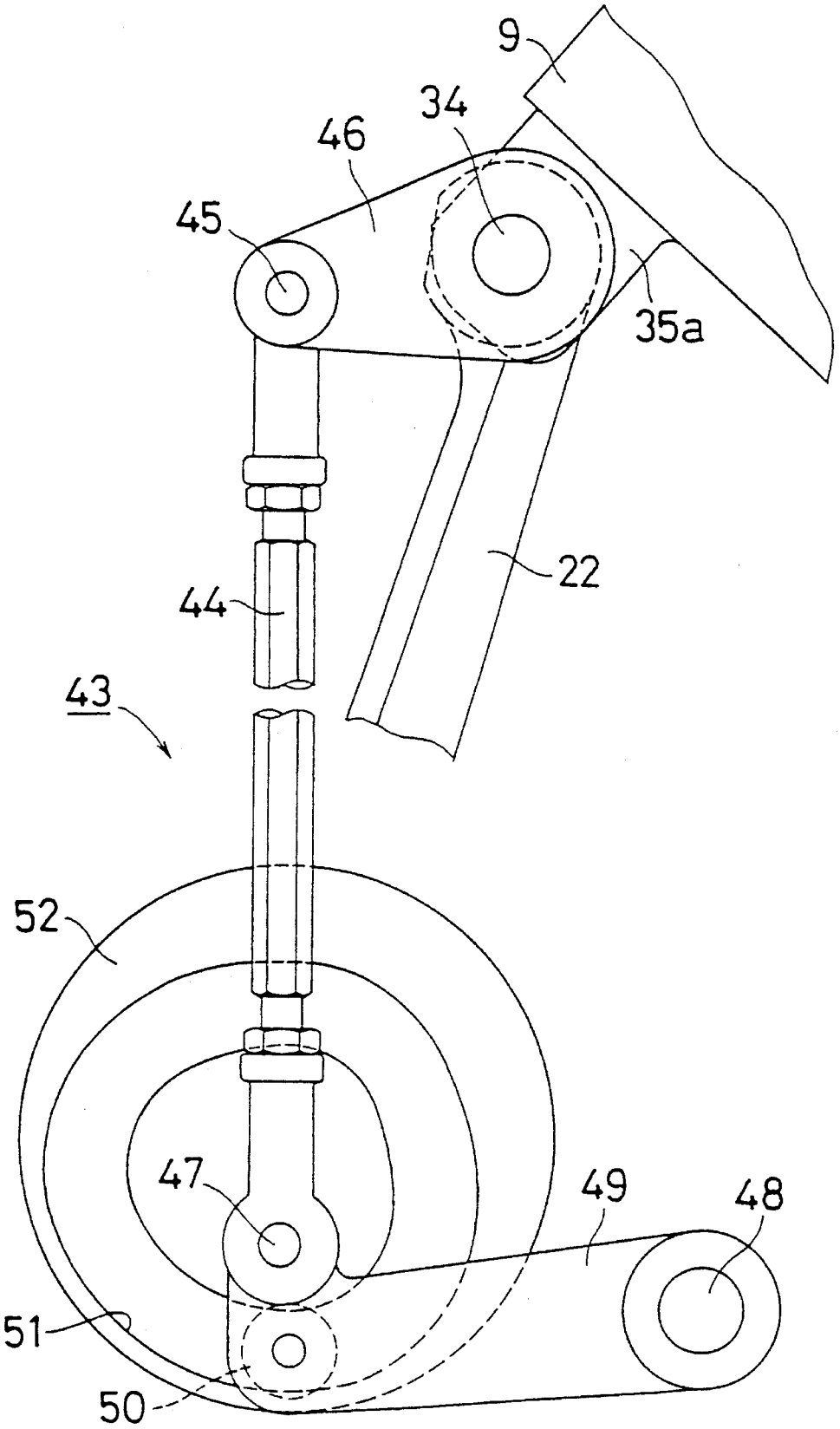
FIG. 11 is a simplified side view showing the constitution of an oscillating mechanism in the embodiment of FIG. 1.
Figure 12:
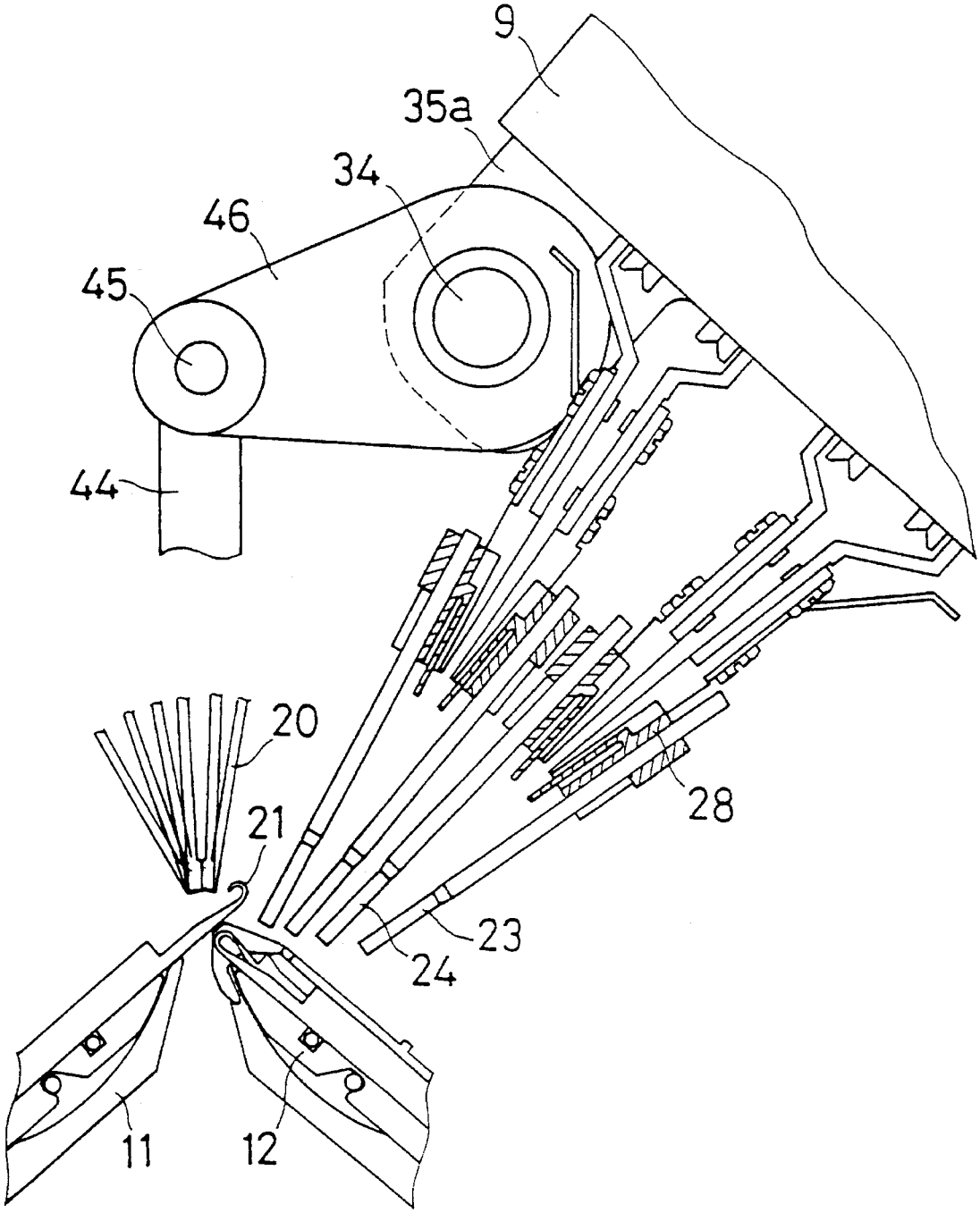
FIG. 12 is a simplified side view showing the state of swing motion in the embodiment of FIG. 1.
Figure 13:
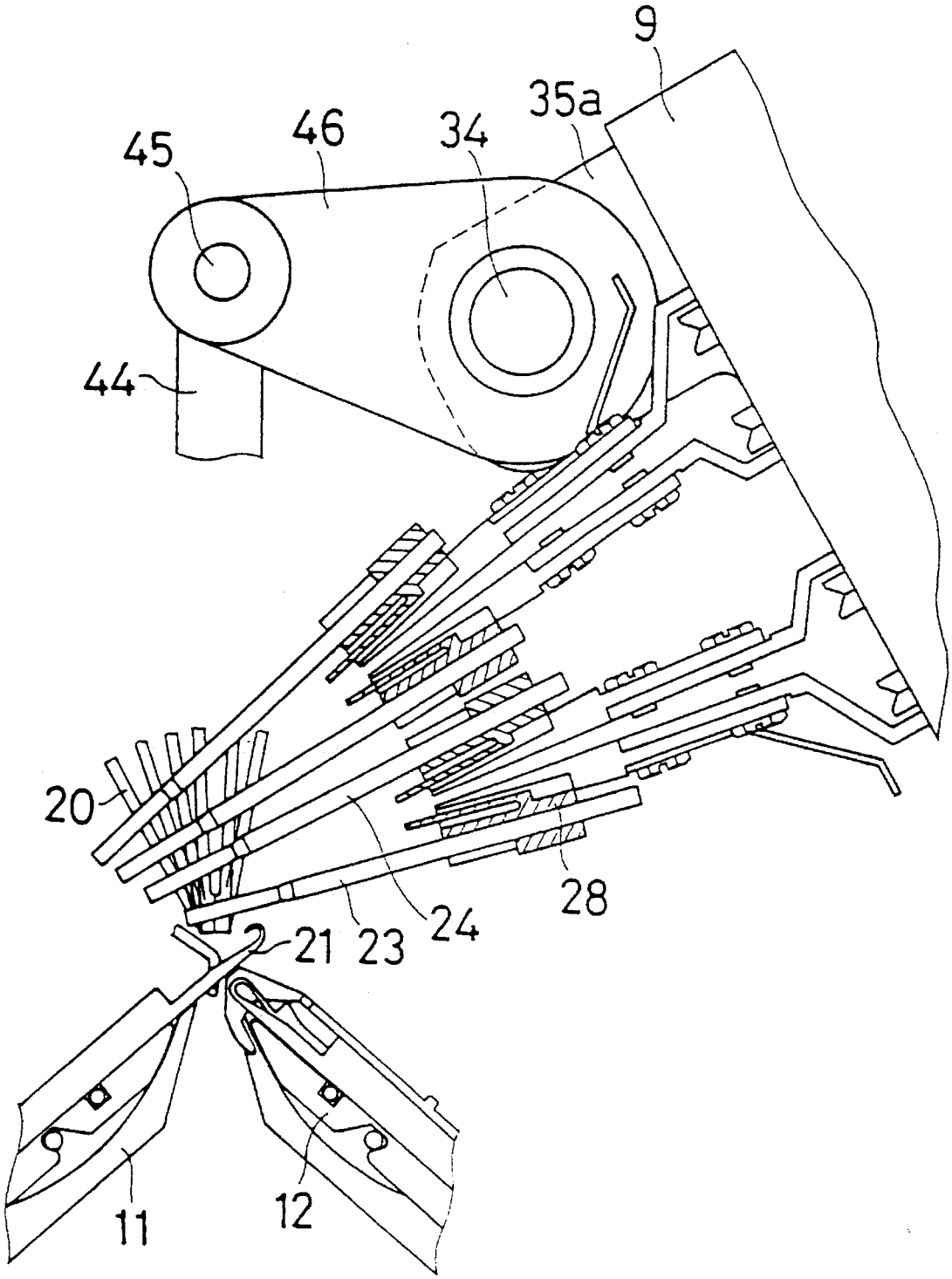
FIG. 13 is a simplified side view showing the state of swing motion in the embodiment of FIG. 1.

FIGS. 1 through 17 show a schematic constitution of an embodiment of the invention. FIG. 1 is a sectional view of a flat knitting machine as seen from a side, FIG. 2 is a front view of principal parts in FIG. 1, FIG. 3 is a partially magnified view of FIG. 1, FIG. 4 and FIG. 5 are magnified views of the left side of FIG. 2, FIG. 6 and FIG. 7 are magnified views of the right side of FIG. 2, FIG. 8 shows a front view, a plan view and a side view of a holding block, FIG. 9 shows a coupled state of a holding block and a lace bar, FIG. 10 shows a mounted state of a holding block on a lace bar, FIG. 11 shows a constitution of a mechanism for swing motion, FIG. 12 and FIG. 13 show a constitution near nozzle in swing motion, FIG. 14 shows a time relation of knitting yarn feed and carriage motion, and FIGS. 15, 16 and 17 show examples of knitting the same pattern by changing the combination of lace bars and drive belts.

As mainly shown in FIG. 1, a knitting yarn feeding apparatus 9 is provided as one of the components for a flat knitting machine 10. The flat knitting machine 10 comprises a front needle bed 11 and a rear needle bed 12, and carriages 13, 14 are free to run reciprocally thereon in the longitudinal direction. Moreover, the carriages 13, 14 may be also driven independently back and forth. From the carriage 13 running on the front needle bed 11, a bridge 15 is extended upward, and it is further folded in the horizontal direction, extended to the rear needle bed 12 side, and guided, at its front end, by a roller 17 along a guide 16. The guide 16 is supported by a post 18. The post 18 supports knitting yarn guide rails 19 so as to be parallel to the front needle bed 11 and rear needle bed 12, beneath the horizontal portion of the bridge 15. On the knitting yarn guide rails 19, plural knitting yarn guides 20 run in the longitudinal direction, and the front end of each knitting yarn guide 20 is opposite to the nozzle formed between the front needle bed 11 and rear needle bed 12.

Plural knitting needles 21 are provided, retractably from the front needle bed 11 and rear needle bed 12 toward the nozzle. Each knitting needle 21 is displaced retractably toward the nozzle by the action of a cam provided in a cam box in the carriages 13, 14 according to its running. The knitting yarn feeding apparatus 9 is used to feed knitting yarn to the knitting needles 21 of only one needle bed, or of only the front needle bed 11 in the embodiment.

The knitting yarn feeding apparatus 9 is supported by a frame of the flat knitting machine 10 by a post 22. In the knitting yarn feeding apparatus 9, from a feeding member composed of plural feeder tubes 23, 24 mounted on plural support members of lace bars 25, 26, knitting yarn is paid out to near the nozzle between the front needle bed 11 and rear needle bed 12. In this embodiment, another pair of lace bars similar to two rows of lace bars 25, 26 are disposed, and there are four rows in total. Inside the knitting yarn feeding apparatus 9 is provided a mechanism for lapping motion for displacing and driving the lace bars 25, 26 for holding the feeder tubes 23, 24, reciprocally in the longitudinal direction of the front needle bed 11 and rear needle bed 12. The entire knitting yarn feeding apparatus 9 is oscillated and displaced in a plane vertical to the axial direction of the front needle bed 11 and rear needle bed 12, by an oscillating mechanism provided in a frame beneath the front needle bed 11 and the rear needle bed 12.

As mainly shown in FIG. 2, the lace bars 25, 26 as the base of the knitting yarn feeding member, can be provided in a plurality, for example, two on the same guide route of one base body 27. Or only one may be provided. Plural holding blocks are detachably fitted to each one of lace bars 25, 26. The lace bars 25, 26 are driven reciprocally in the longitudinal direction of the base body 27 by drive belts 29 and motors 30, individually. In each holding block 28, plural feeder tubes 23, 24 can be fitted, and by the reciprocal motion of the lace bars 25, 26, lapping motion is achieved. The possible stroke of lapping motion is determined by an interval D between the lace bars 25 and 26. Supposing the lengths of lace bars 25, 26 to be L1, L2, and the length of the range in the base body 27 in which the lace bars 25, 26 are movable between the bases 35*a* and 35*b* to be L0, it follows that D=L0–(L1+L2). That is, the interval D is determined by the lengths L1, L2 of the lace bars 25, 26. The drive belt 29 is applied between the motor 30 disposed at one end of the base body 27 in the longitudinal direction, and a pulley 31 provided at the end of the opposite side. Since longitudinal reciprocal motion is effected by the drive belts 29 applied in such a reciprocal direction, if the moving stroke is large, the mechanism for lapping motion of the lace bars 25, 26 is not increased in size, and hence the length in the widthwise direction of the flat knitting machine 10 is not extended.

As mainly shown in FIG. 3, the respective lace bars 25 can be disposed in plural, for example, four lace bars disposed on guide routes, by making use of both surface and back sides of, for example, two respective tracks 27*a*, 27*b* provided on the base body 27. Rollers 32, 33 are provided on a coupling plate 36*a* for coupling the tracks 27*a*, 27*b* and lace bars 25. Each lace bar 25 is tightened by a pressing plate 37, and is coupled with a selected one of plural drive belts 29*a*, 29*b*. To avoid overlapping, in FIG. 2, only the lace bars 25, 26 provided on the guide route of the extreme surface side are shown, but a total of eight lace bars can be provided in four rows of guide routes by using the surface and back sides of the two tracks 27*a*, 27*b*.

As mainly shown in front view in FIG. 4 and plan view in FIG. 5, plural motors 30 are provided at one end side of the base body 27. Drive belts 29*a*, 29*b* are driven respectively by motors 30*a*, 30*b*. Each motor 30 is realized, for example, by a servo motor, and the rotation displacement extent, that is, the feed amount and direction of the drive belt 29 can be freely set. To induce swing motion of the feeder tube 23 through the lace bar 25, a swing shaft 34 is provided. A swing shaft 34 is oscillated and displaced about the swing shaft 34 by an oscillation mechanism 43 provided beneath the front needle bed 11 and rear needle bed 12. The plural motors 30 are mounted on a base 35*a* provided at the left side of the base body 27. The drive belts 29 and lace bars 25 are connected via the coupling plate 36*a*. The lace bar 25 and coupling plate 36*a* are mounted by bolts 25*a*, 25*b*. The bolts 25*a*, 26*b* penetrate through a slot 25*c* formed in the lace bar 25, and are engaged with screw holes formed in the coupling plate 36*a* (shown in FIG. 2). The other coupling plates 36*b*, 36*c* and lace bars 25, 26 are similarly mounted.

The interval D shown in FIG. 2 is adjusted, for example, in the case of the lace bars 25, by fitting lace bars 25 different in length to respective coupling plates by detaching the left side coupling plate 36*a*, right side coupling plate 36*b*, and middle coupling plate 36*c*, and shifting the right side and middle coupling plates 36*b*,36*c* to the left side or the right side. The lace bar 25 is detached after detaching all coupling plates 36. Moreover by removing the pressing plate 37, the coupling plate 36 and drive belt 29*a* can be disengaged from each other, so that the coupling plate 36*a* can be separated from the base body 27. When the pressing plate 37 is engaged with the lower side drive belt 29*b*, the lace bar 25 can be driven by a different motor 30.

As shown mainly in front view in FIG. 6 and plan view in FIG. 7, plural pulleys 31 are provided in the base 35*b* at the other end side of the base body 27, and the drive belts 29 are folded back. A shaft-bearing is provided in the portion where the swing shaft 34 penetrates through the post 22.

Figure 8A:
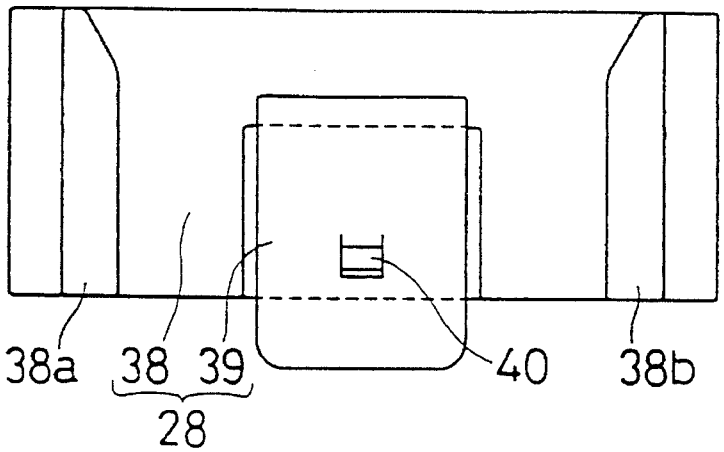
FIGS. 8A–8C show a front view, a plan view, and a side view of a holding block 28 in the embodiment of FIG. 1.
Figure 8B:
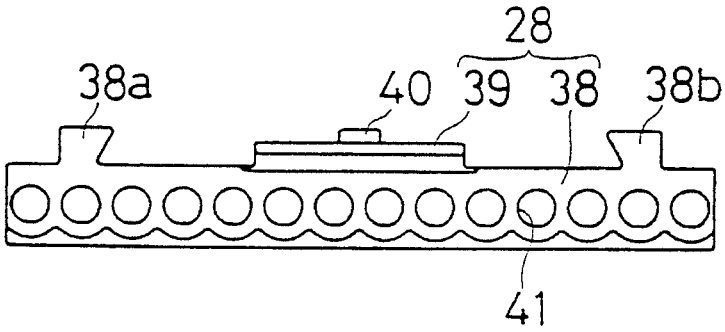
Figure 8C:
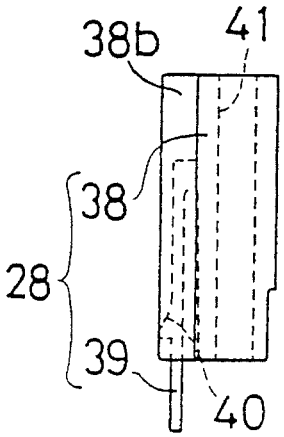

As shown mainly in FIG. 8, each holding block 28 contains a block 38 and a stopper 39. The block 38 and stopper 39 are, for example, an integrally formed synthetic resin, and a pawl 40 is provided in the stopper 39. In the block 38, penetration holes 41 for plural feeder tubes 23, 24, and protrusions 38*a*, 38*b* of both sides are formed. The inside diameter of the penetration holes 41 is set slightly smaller than the outside diameter of the feeder tubes 23, 24, so that the feeder tubes 23, 24 can be inserted and fixed at desired positions. FIG. 8A is a front view, FIG. 8B is a plan view, and FIG. 8C is a side view.

As mainly shown in FIGS. 9 and 10, in each holding block 28, protrusions 38*a*, 38*b* are inserted into fitting grooves 42*a*, 42*b* at both sides of the lace bars 25, 26, the stopper 39 is inserted into the engaging groove 42*c*, and is stopped by the pawl 40 which gets into an engaging recess 42*d*. When detaching, the front end 39*a* of the stopper 39 is pressed to clear engagement with the pawl 40. In FIGS. 2, 4, 6, and 9, the middle engaging groove 42*c* is shown as the fitting groove 42.

As mainly shown in FIG. 11, the oscillating mechanism 43 for oscillating and displacing the knitting yarn feeding apparatus 9 is realized by the combination of an arm 46 capable of reciprocally oscillating and displacing, which is connected via a pin 45 at the left end side of the swing shaft 34 to the upper portion of a rod 44 displaced reciprocally, for example, in the vertical direction, and an arm 49 capable of oscillating and displacing about the swing shaft 48, which is connected via a pin 47 beneath the rod 44. The swing shaft 34 is coupled with the arm 46 and base 35*a*, and is also coupled with the base 35*b* at the right end side. The vertical displacement of the rod 44 is realized by rotating and driving a cam plate 52 formed by eccentric form of a cam groove 51 engaged with a follower 50 provided on the arm 49.

FIG. 12 and FIG. 13 show the state of swing motion. FIG. 12 shows the state that the front ends of the feeder tubes 23, 24 are located at the lower side of the knitting needle 21 when the front end of the feeder tubes 23, 24 projects from the front needle bed 11, and FIG. 13 shows the state at the upper side of the knitting needle 21 of the same state. In knitting, compound needles are used, but latch needles and others may be also used. Since the knitting machine of the invention is constituted so as to be capable of inverting at an arbitrary point on the needle bed, the carriage for projecting the knitting needle 21 may not always penetrate completely over the needle bed.

Figure 14A:
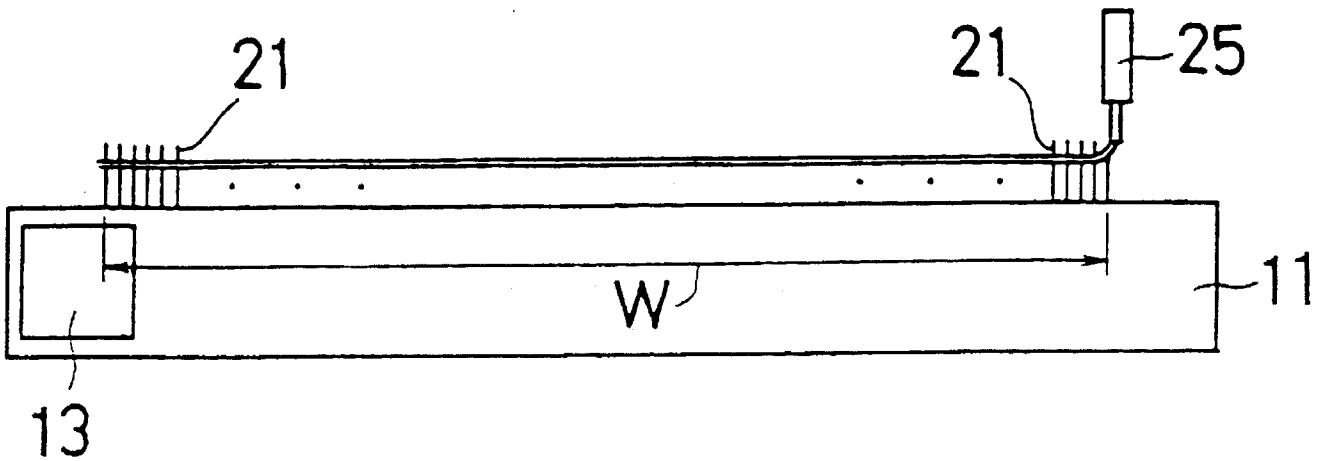
FIGS. 14A, 14B are schematic diagrams showing the time relation of the lapping motion and carriage motion.
Figure 14B:
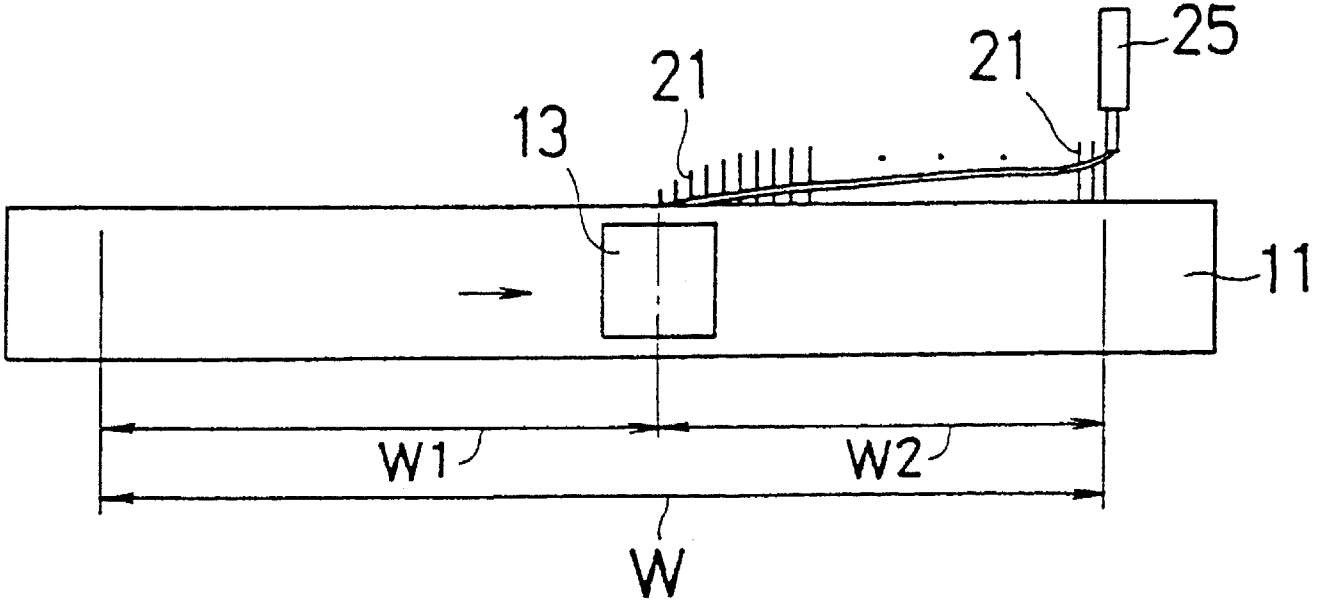

As shown in FIG. 14A, usually, knitting is started by moving the carriage 13 after lapping is completed as in FIG. 14A. As in FIG. 14B, when the carriage 13 is moved so as to follow up the lace bar 25 in the process of lapping, the knitting time can be shortened as compared with the case of moving the cartridge 13 after waiting until the lace bar 25 completes lapping motion. Symbol W denotes the lapping range, and the knitting needle 21 is projecting in the whole range in FIG. 14A. In FIG. 14B, by the move of the carriage 13, the knitting needles are retracted within the range of W1, projecting in the range of W2.

FIGS. 15, 16, and 17 show examples of knitting the same pattern by varying the combination of coupling plural lace bars and drive belts.

Figures 15A, 15B, 15C, 15D:
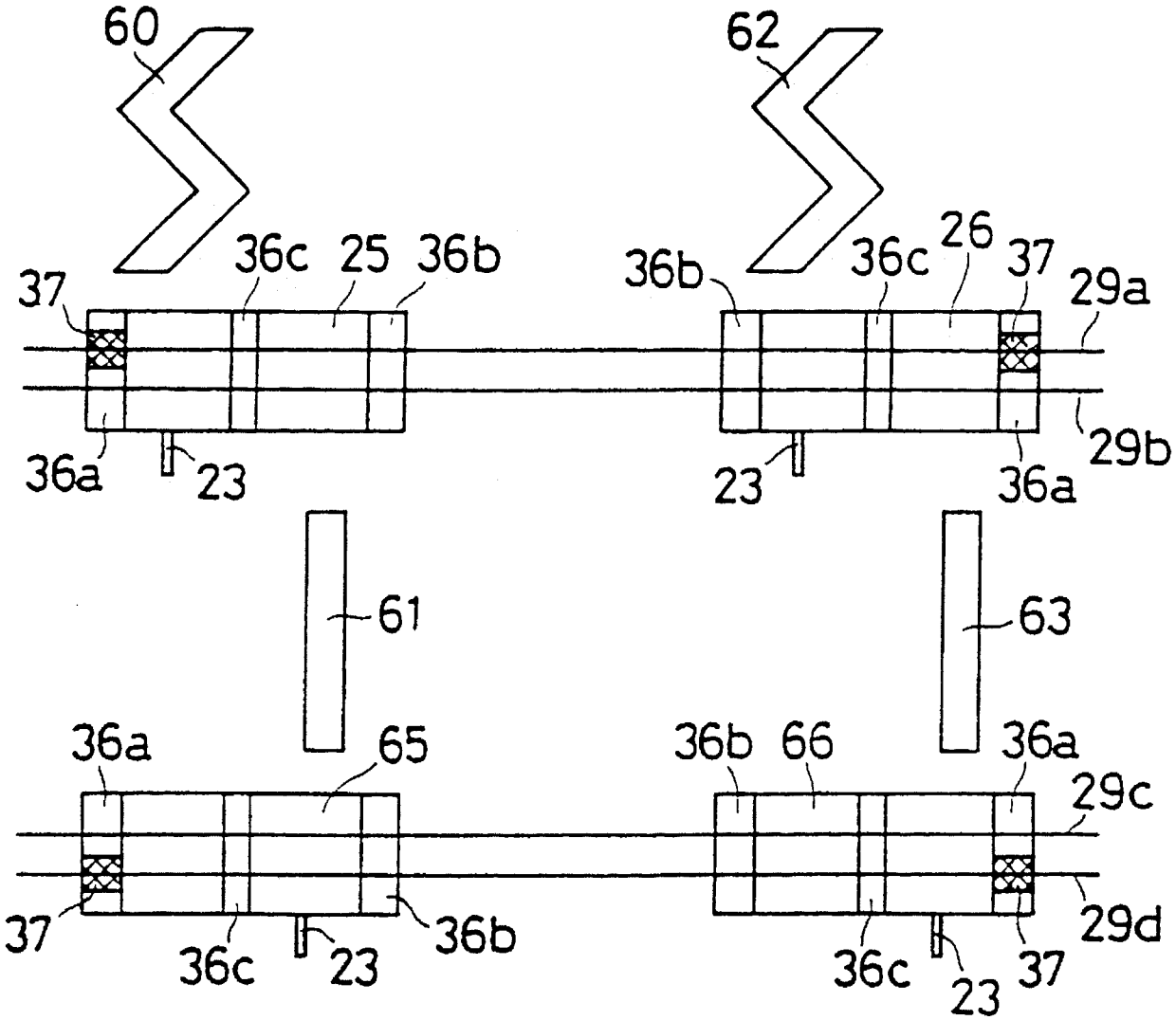
FIGS. 15A–15D are schematic diagrams showing the relation between the layout of lace bar and knitting pattern possible to knit in the first embodiment of FIG. 1.
Figures 16A, 16B, 16C, 16D:
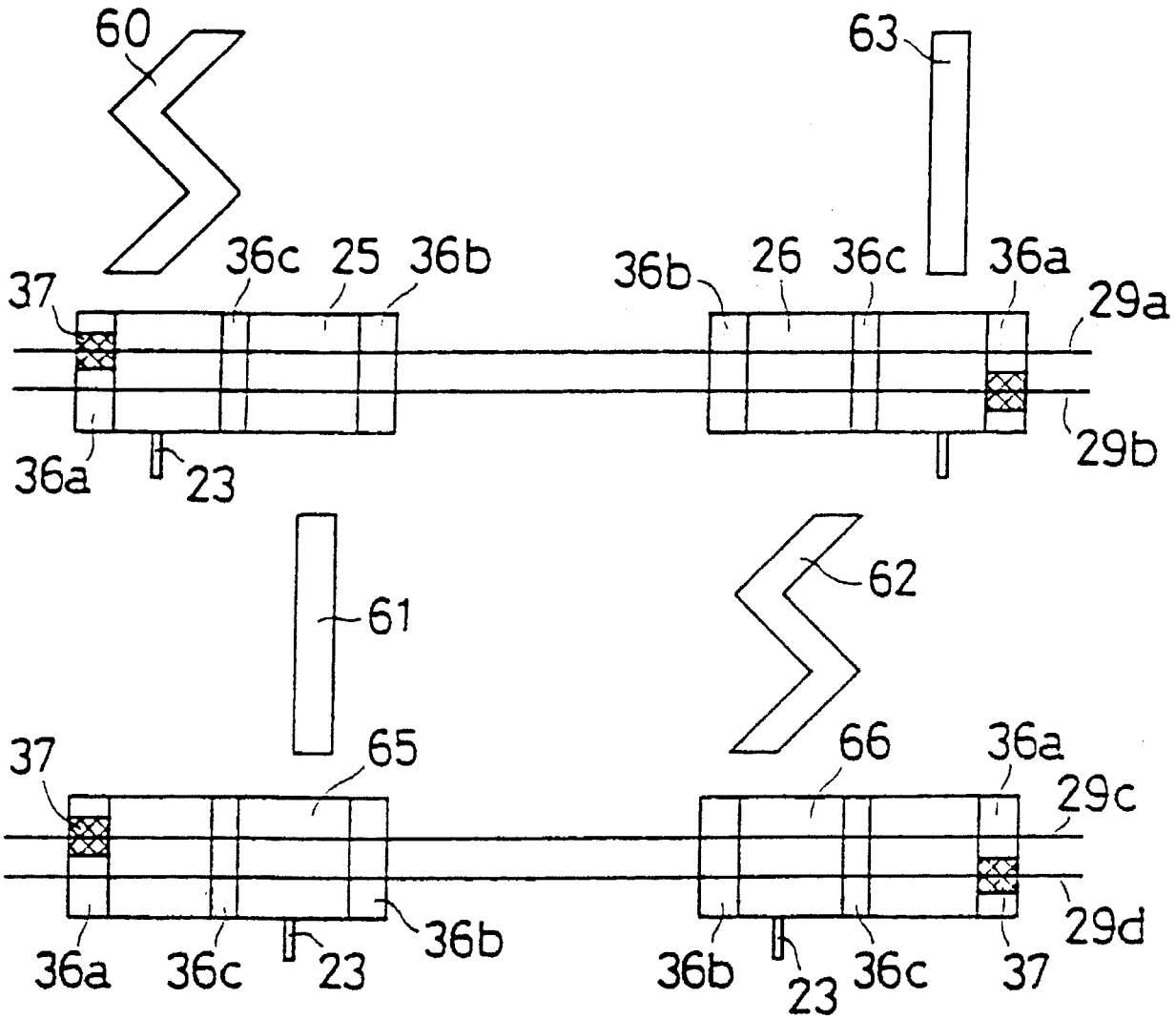
FIGS. 16A–16D are schematic diagrams showing the relation between the layout of lace bar and knitting pattern possible to knit in the embodiment of FIG. 1.

Patterns 60, 61, 62, 63 as shown in FIG. 15A, 15C, and FIG. 16A, 16C can be formed by using two rows of guide routes as shown in FIG. 15B and FIG. 15D, or FIG. 16B and FIG. 16D. Patterns 60, 62 in FIG. 15A are formed by using the lace bars 25, 26 in FIG. 15B, and patterns 61, 63 in FIG. 15C, by lace bars 65, 66 in FIG. 15D, and one of the drive belts 29*a*, 29*b* is used in each row, respectively. Other drive belts 29*b*, 29*c* can be used for knitting other patterns by driving other lace bars. Similar knitting can be formed by using a long lace bar by coupling the lace bars 25, 26 and lace bars 65, 66, one in each row. Patterns 60, 61, 63, 62 shown in FIG. 16A and FIG. 16C can be formed by lace bars 25, 65, 26, 66, respectively. The lace bars 25, 26, 65, 66 are individually driven by the drive belts 29*a*, 29*b*, 29*c*, 29*d*. Of course, the patterns 60, 61, 62, 63 may be different patterns.

Figures 17A, 17B:
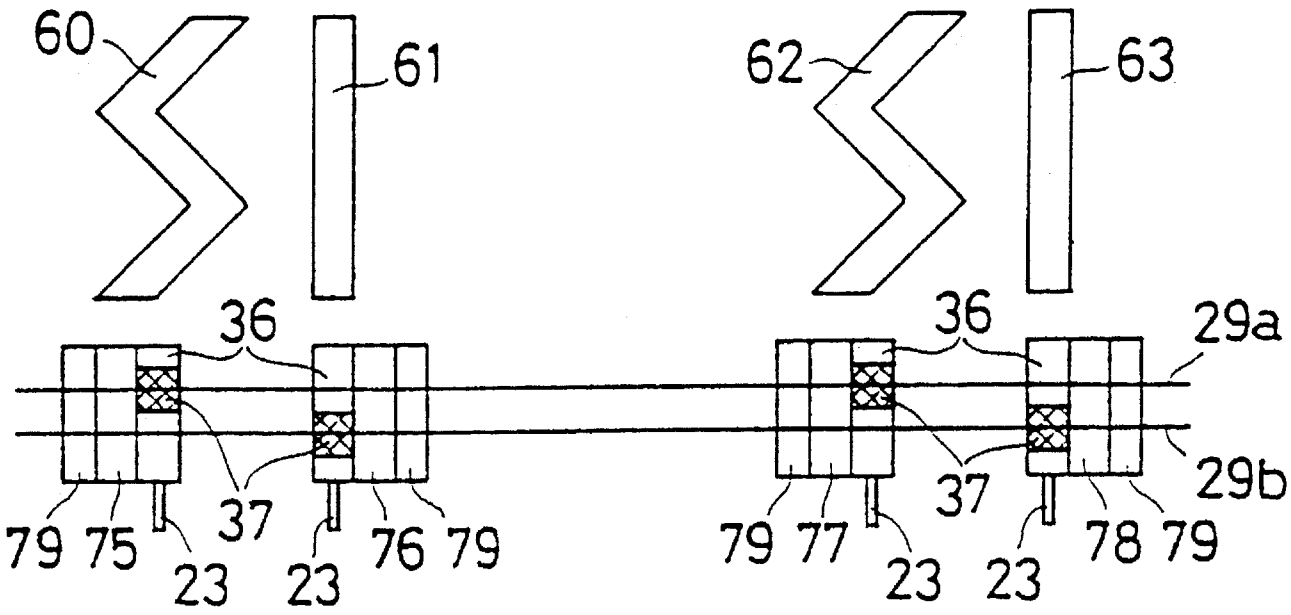
FIGS. 17A, 17B are schematic diagrams showing the relation between the layout of lace bar and knitting pattern possible to knit in the embodiment of FIG. 1.
Figure 18:
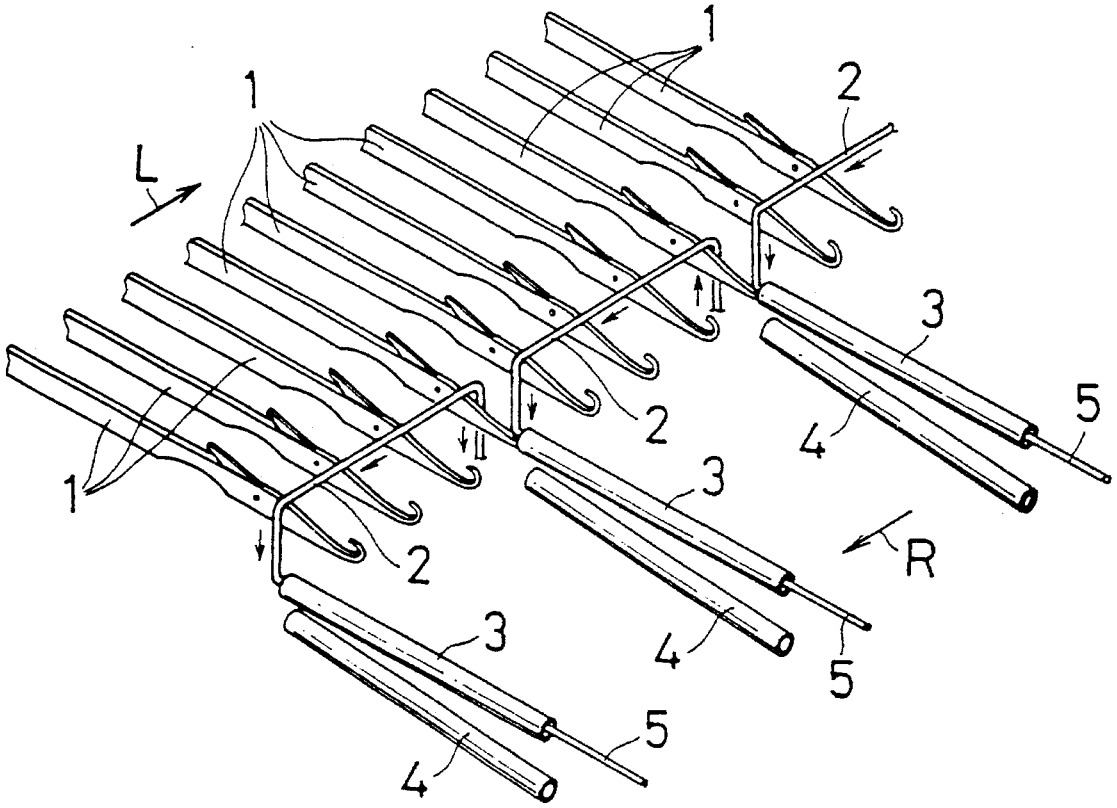
FIG. 18 is a perspective view for explaining the motion when performing warp knitting by using a flat knitting machine.

In FIG. 17B, in the same guide route, four lace bars 75, 76, 77, 78 and the two drive belts 29*a*, 29*b* are disposed, and are coupled with coupling plates 36, 79. Via the pressing plate 37, the lace bars 75, 77 are engaged with the drive belt 29*a*, and lace bars 76, 78 with the drive belt 29b. The drive belts 29*a*, 29*b* are not engaged with each other at a coupling plate 79, and support is effected by rollers 32, 33 as shown in FIG. 3. By shortening the length of the lace bars 75, 76, 77, 78, and driving the drive belts 29*a*, 29*b* separately, patterns 60,61, 62, 63 as shown in FIG. 17(A) can be formed depending on the motion of the lace bars 75, 76, 77, 78.

In FIGS. 17A, 17B, in one row of guide route, the same patterns by using two rows as shown in FIG. 15 and FIG. 16 can be formed. Moreover, only by changing the combination of coupling the lace bars 75, 76, 77, 78 and the drive belts 29*a*, 29*b*, the layout of the patterns 60, 61, 62, 63 can be changed easily. Although the lengths of the lace bars 75, 76, 77, 78 are short, they may be further shortened, or feeder tubes 23, 24 may be directly fitted to the coupling plate 36. In the prior art, since the feeder tubes are accommodated at plural positions of the lace bar (feeder rod in Japanese Examined Patent Publication JP(B2) 51-42225 (1976)) in a length close to the overall width of the needle bed, stroke of the lapping motion is limited. By using only one feeder tube in one track, the stroke of the lapping motion is not limited, so that, for example, the entire width of the needle bed can be lapped.

What is claimed is:

1. A knitting yarn feeding apparatus for a flat knitting machine, the apparatus feeding knitting yarn to knitting needles of a flat knitting machine, comprising:

a base body having a guide route extending along a needle bed in a longitudinal direction, a knitting yarn feeding member detachable from the base body and movable reciprocally on the guide route of the base body, for feeding the knitting yarn to the knitting needles projecting from the needle bed by a predetermined height, a drive belt applied to move reciprocally in the longitudinally direction of the base body, and having the knitting yarn feeding member coupled at one side thereof, a motor provided at a longitudinal end of the base body, for driving the knitting yarn feeding member reciprocally in the longitudinal direction of the base body through the drive belt, and an oscillating mechanism coupled to the base body for displacing and driving the base body in a flat plane vertically to the longitudinal direction of the base body.

2. The apparatus of claim 1, wherein plural guide routes are provided on the base body, plural knitting yarn feeding members are guided on one and the same guide route, plural drive belts and plural motors coupled with each knitting yarn feeding member are provided, and driving in plural modes is realized on said one and the same guide route.

3. The apparatus of claim 2, wherein the coupling combination among the plural knitting yarn feeding members guided on said one and the same guide route, plural drive belts, and motors is changeable.

4. The apparatus of any one of claims 1 to 3, wherein the plural knitting yarn feeding members are reciprocally movable on the base body in the longitudinal direction, and the intervals among the knitting yarn feeding members are adjustable.

5. The apparatus of claim 1, wherein the knitting yarn feeding member comprises a feeder tube for feeding the knitting yarn to the knitting needles from the front end thereof, a holding block for inserting and holding the feeder tube, and a support member provided with fitting grooves, the holding block has a stopper composed of an elastic spring for fitting into the fitting groove formed in the support member, and by pressing and deforming the stopper, the holding block can be detached from the support member.

6. The apparatus of claim 2, wherein the knitting yarn feeding member comprises a feeder tube for feeding the knitting yarn to the knitting needles from the front end thereof, a holding block for inserting and holding the feeder tube, and a support member provided with fitting grooves, the holding block has a stopper composed of an elastic spring for fitting into the fitting groove formed in the support member, and by pressing and deforming the stopper, the holding block can be detached from the support member.

7. The apparatus of claim 3, wherein the knitting yarn feeding member comprises a feeder tube for feeding the knitting yarn to the knitting needles from the front end thereof, a holding block for inserting and holding the feeder tube, and a support member provided with fitting grooves, the holding block has a stopper composed of an elastic spring for fitting into the fitting groove formed in the support member, and by pressing and deforming the stopper, the holding block can be detached from the support member.

8. The apparatus of claim 4, wherein the knitting yarn feeding member comprises a feeder tube for feeding the knitting yarn to the knitting needles from the front end thereof, a holding block for inserting and holding the feeder tube, and a support member provided with fitting grooves, the holding block has a stopper composed of an elastic spring for fitting into the fitting groove formed in the support member, and by pressing and deforming the stopper, the holding block can be detached from the support member.

* * * * *